US011065500B1

(12) United States Patent
Tuck

(10) Patent No.: US 11,065,500 B1
(45) Date of Patent: Jul. 20, 2021

(54) ALL-IN-ONE EXERCISE MACHINE FOR DEVELOPING SPEED, AGILITY, AND STRENGTH

(71) Applicant: Keith Tuck, Montgomery, AL (US)

(72) Inventor: Keith Tuck, Montgomery, AL (US)

( * ) Notice: Subject to any disclaimer, the term of this patent is extended or adjusted under 35 U.S.C. 154(b) by 0 days.

(21) Appl. No.: 16/364,470

(22) Filed: Mar. 26, 2019

(51) Int. Cl.
*A63B 22/02* (2006.01)
*A63B 21/00* (2006.01)
*A63B 22/00* (2006.01)

(52) U.S. Cl.
CPC ..... *A63B 21/153* (2013.01); *A63B 21/4009* (2015.10); *A63B 21/4017* (2015.10); *A63B 22/0023* (2013.01); *A63B 22/02* (2013.01)

(58) Field of Classification Search
CPC ... A63B 22/002; A63B 22/02; A63B 22/0235; A63B 22/0285; A63B 21/15; A63B 21/151; A63B 21/153; A63B 21/22; A63B 21/4001; A63B 21/4007; A63B 21/4009; A63B 21/4017; A63B 21/4021
See application file for complete search history.

(56) References Cited

U.S. PATENT DOCUMENTS 1,016,729 A * 2/1912 Name not available ..... A63B 22/02 482/54
5,472,394 A * 12/1995 Michaelson ..... A63B 21/0088 244/142
6,123,649 A * 9/2000 Lee ..... A63B 21/153 482/51
6,213,922 B1 * 4/2001 Afanasenko ..... A61F 5/01 482/124
6,652,427 B2 * 11/2003 Wroclawsky ..... A63B 22/02 482/111
9,199,110 B2 * 12/2015 Jones ..... A63B 23/047
9,795,819 B2 * 10/2017 Wehrell ..... A63B 21/0552
10,426,989 B2 * 10/2019 Dalebout ..... A63B 22/02
10,569,121 B2 * 2/2020 Watterson ..... A63B 21/00192
2009/0209396 A1 * 8/2009 Ferguson ..... A63B 21/4017 482/139
2010/0144496 A1 * 6/2010 Schmidt ..... A63B 21/4035 482/70
2015/0080181 A1 * 3/2015 Skulman ..... A63B 22/02 482/3
2016/0038785 A1 * 2/2016 Netter ..... A47B 21/04 482/4

* cited by examiner

*Primary Examiner* — Garrett K Atkinson
*Assistant Examiner* — Zachary T Moore
(74) *Attorney, Agent, or Firm* — Peter Loffler

(57) ABSTRACT

An all-in-one exercise machine that is designed to increase a user's speed, agility, and strength uses a treadmill, either motorized or manual, that can be inclined. A resistance hub attaches via a cable to a body harness worn by the user and acts as a resistive take up reel against the user's running. Smaller resistance hubs attach via cables to elbow and hand sleeves worn by the user and resist against the back and forth arm movements of the user while the user is running on the treadmill. These latter resistance hubs also act as weight resistance hubs for weight training on the device, the cables having appropriate weight lifting implements attached thereto.

16 Claims, 7 Drawing Sheets

ALL-IN-ONE EXERCISE MACHINE FOR DEVELOPING SPEED, AGILITY, AND STRENGTH

BACKGROUND OF THE INVENTION

1. Field of the Invention

The present invention relates to a multi-station exercise machine, build around a treadmill base, wherein the exercise machine trains a person's arms and legs in order to build strength, speed, and agility through a variety of exercises.

2. Background of the Prior Art

Football is a tough game played by tough men, and lately, to some extent, women. In order to be a standout player, one needs to have, in addition to a proper intellect for the game, a combination of strength, speed, and agility irrespective of the position played. While a defensive lineman does not need to be able to run 40 yards in 4.40 seconds, he must be able to beat the corresponding offensive lineman if he wants a shot at the quarterback. In fact, many coaches argue that of the three main physical criteria for a player, that speed for a given position is the most important trait of the three. While football may be viewed as the pinnacle of hardnosed sports, these same three physical traits are equally important in almost all other sports. A slow outfielder is not going to be able to effectively chase down the pop fly nor is a hockey player of modest strength going to be able to check past the big defenseman positioned between this player and the net.

In order to get stronger, faster, and more agile, athletes spend countless hours in the weight room, doing arm curls, bench presses, squats, deadlifts, and a whole host of other exercises in order to improve their physical capabilities, often under the tutelage of a coach. While strength training is a tried and true method for improving the various physical traits needed by premier athletes, there are certain shortcomings. Outfitting a weight room is a relatively costly endeavor. Various benches and platforms are needed as are a large number of weight bars and weight plates. Such benches and weights are costly to obtain, especially if quality is a concern. Additionally, modern gyms are also outfitted with various muscle specific machines such as a butterfly press or a lat pull-down machine, none of these machines being inexpensive to obtain. Add to this the need for a sizable piece of real estate to hold all of these items and it is evident that weight rooms are high cost necessities for athletic development. Nevertheless. such facilities are typically found at high schools, colleges, and universities that are committed to a strong athletic program. Additionally, commercial gyms are plentiful, especially in urban areas, albeit such gyms are typically quite expensive to join.

Accordingly, most athletes go to the gym at the school that they attend or to a commercial gym to get a substantial portion of their physical training—often supplemented by street jogging (weather permitting), pushups, sit ups, etc., which can be performed at home. However, going to the gym is not a complete solution to many. Many student athletes do not live close to the school's facility to make frequent trips to the gym practical. Additionally, many school gyms have limited hours so that often the athlete is shutout during the hours he or she desires to train. An athlete returning to his or her hometown for the summer is unable to attend the school's facility, irrespective of the gym's hours of operations. Top this all off with the fact that many gyms are often so crowded that a good percentage of time at the gym is spent waiting for a particular piece of equipment to become free and it becomes evident that gym usage is not a complete solution for an athlete's physical development, irrespective of the sport that the athlete participates in.

What is needed is a way for an athlete to be able develop speed, strength and agility without the typical hassles associated with modern gym usage. Specifically, the athlete should be able to have a solid and steady workout at any hour and at a large number of locations that are not necessarily a gym. The workout received by the athlete must be as rigorous as can be achieved at a typical gym.

SUMMARY OF THE INVENTION

The all-in-one exercise machine for developing speed, agility, and strength of the present invention addresses the aforementioned needs in the art by providing, in a single package, a device that focuses on the development of the muscle groups that are needed for speed, agility, and strength so as to improve the athlete's physical traits in these areas. The all-in-one exercise machine for developing speed, agility, and strength is a single unit device that has a footprint only marginally larger than a typical treadmill so that it can be housed in many locations such as a bedroom or an under-utilized dining room, a garage, a basement etc., so that a user is not tied to a gym and its potentially restrictive hours and the hassles of overcrowding. The all-in-one exercise machine for developing speed, agility, and strength is sufficiently small so that a person using the device can pack the machine up and either place it in the back of a pickup truck or into a small trailer and take the machine home during summer break, for example, and then return the machine back to his or her living quarters when school resumes in the fall. The all-in-one exercise machine for developing speed, agility, and strength is of relatively simple design and construction, being produced using standard manufacturing techniques, so as to be relatively inexpensive to produce so as to be economically attractive to potential consumers for this type of device. The all-in-one exercise machine for developing speed, agility, and strength is relatively easy to assemble and disassemble as needed. Usage of the all-in-one exercise machine for developing speed, agility, and strength is simple and straightforward.

The all-in-one exercise machine for developing speed, agility, and strength is comprised of a main deck that has a first section and a second section. A treadmill (manual or electric) is located on the second section of the main deck. The treadmill has a front end and a back end and also has a continuous running belt thereon as is appropriate for a treadmill. A first resistance hub is located on the second section of the main deck proximate the back end of the treadmill. The first resistance hub has a first spool that has a first winding force imparted thereon (mechanically or electrically). A first cable has a first end and a second end such that the first end of the first cable is attached to and partially wound about the first spool so that placing a first pulling force on the first cable in order to unwind the first cable from the first spool works against the first winding force imparted on the first spool. A second resistance hub is located on the second section of the main deck proximate the back end of the treadmill on a first side of the first resistance hub. The second resistance hub has a second spool that has a second winding force imparted thereon (either mechanically or electrically). A second cable has a third end and a fourth end such that the third end of the second cable is attached to and partially wound about the second spool so that placing a second pulling force on the second cable in order to unwind the second cable from the second spool works against the second winding force imparted on the second spool. A third resistance hub is located on the second section of the main deck proximate the back end of the treadmill on a second side of the first resistance hub. The third resistance hub has a third spool that has a third winding force imparted thereon (either mechanically or electrically). A third cable has fifth end and a sixth end such that the fifth end of the third cable is attached to and partially wound about the third spool so that placing a third pulling force on the third cable in order to unwind the third cable from the third spool works against the third winding force imparted on the third spool. The angle of incline of the treadmill with respect to the main deck is variable. The first winding force imparted on the first spool is variable. The second winding force imparted on the second spool and the third winding force imparted on the third spool are each variable. A harness is attached to the second end of the first cable. A first hand sleeve is located on the fourth end of the second cable while a second hand sleeve is located on the sixth end of the third cable. A first elbow sleeve is attached to the second cable while a second elbow sleeve is attached to the third cable. A first clip is located on the fourth end of the second cable while a second clip is located on the sixth end of the third cable. At least one third clip is located on a left side of the second section of the main deck while at least one fourth clip is located on a right side of the second section of the main deck. A control console is located on the first section of the main deck. The first section of the main deck is longitudinally movable relative to the second section of the main deck. A series of longitudinal lines is located on the belt as is a series of latitudinal lines so that the series of longitudinal lines and the series of latitudinal lines together form a series of rectangles on the belt.

BRIEF DESCRIPTION OF THE DRAWINGS

Similar reference numerals refer to similar parts throughout the several views of the drawings.

DESCRIPTION OF THE PREFERRED EMBODIMENT

Figure 1:
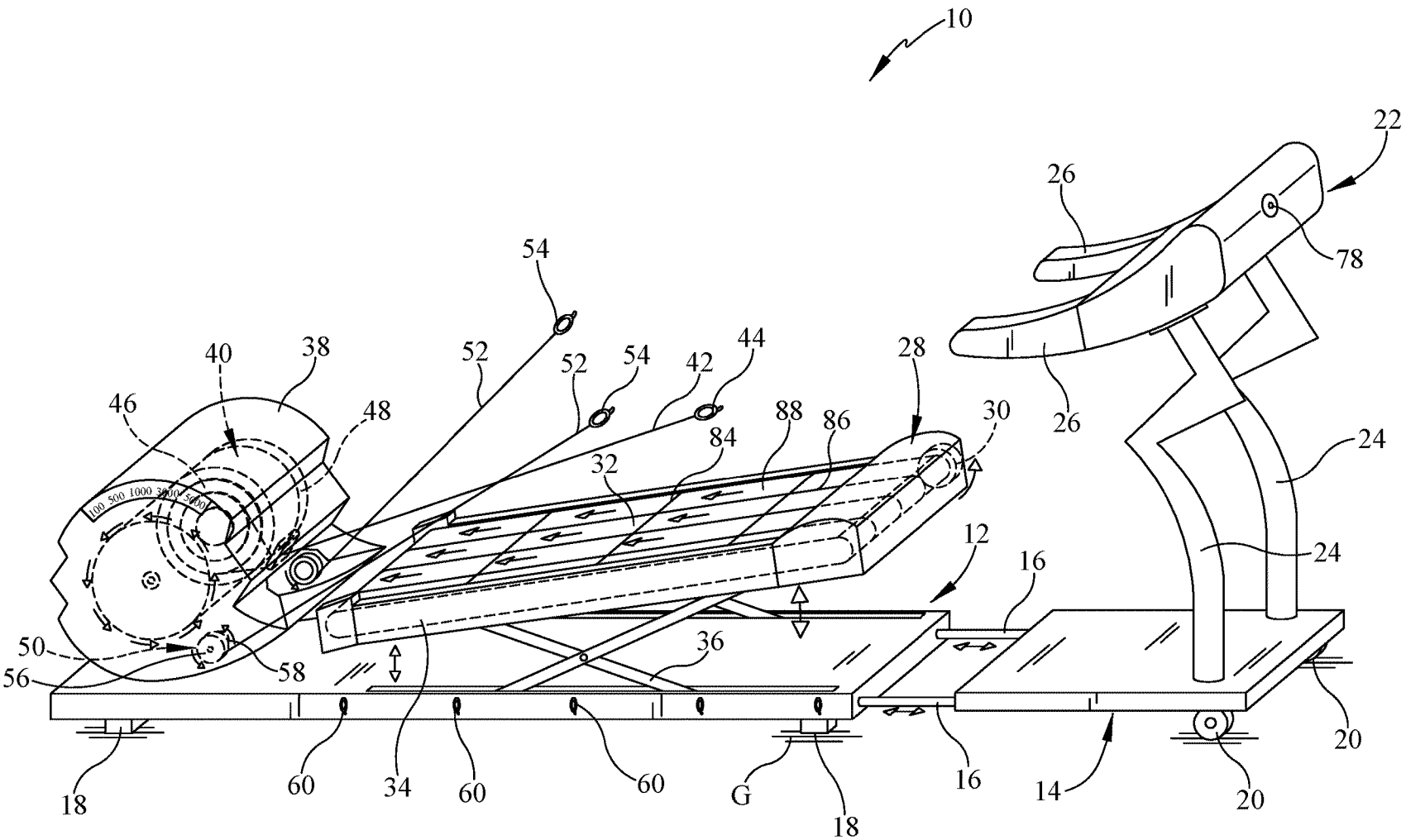
FIG. 1 is a perspective view of the all-in-one exercise machine for developing speed, agility, and strength of the present invention.
Figure 2:
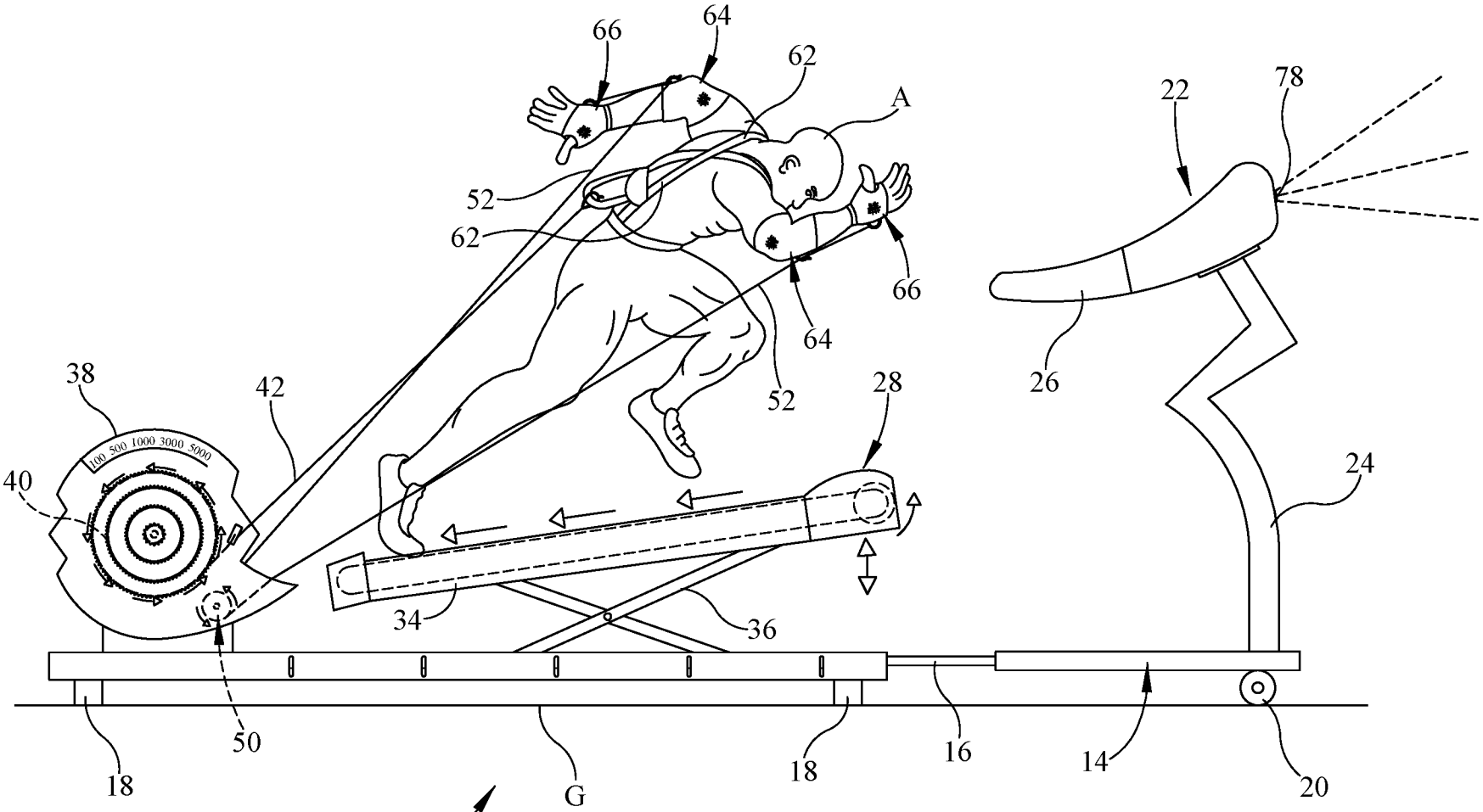
FIG. 2 is an elevation view of the all-in-one exercise machine for developing speed, agility, and strength being utilized by an athlete with the treadmill deck in a relatively shallow angle of incline.
Figure 3:
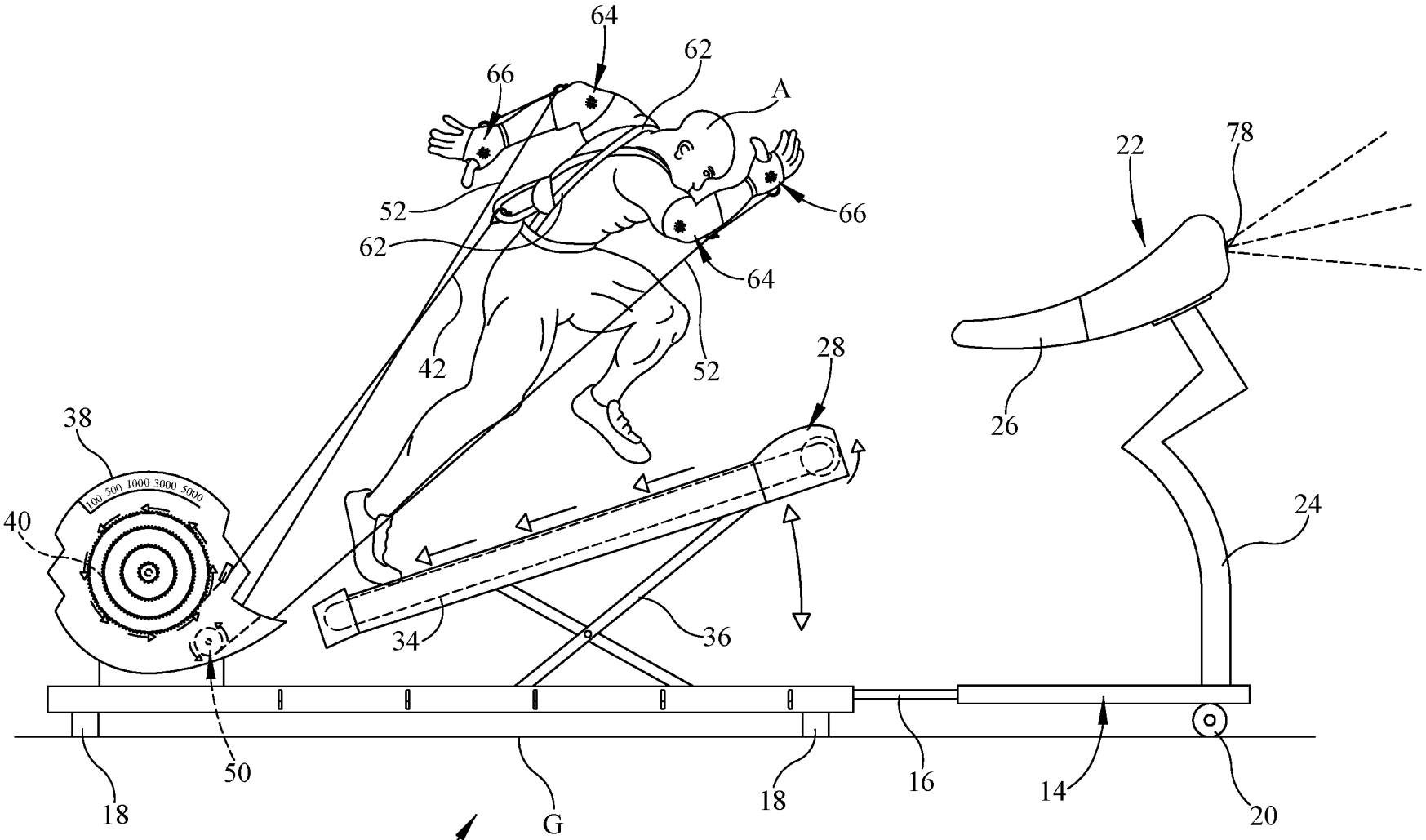
FIG. 3 is an elevation view of the all-in-one exercise machine for developing speed, agility, and strength being utilized by the athlete with the treadmill deck in a relatively steep angle of incline.
Figure 4:
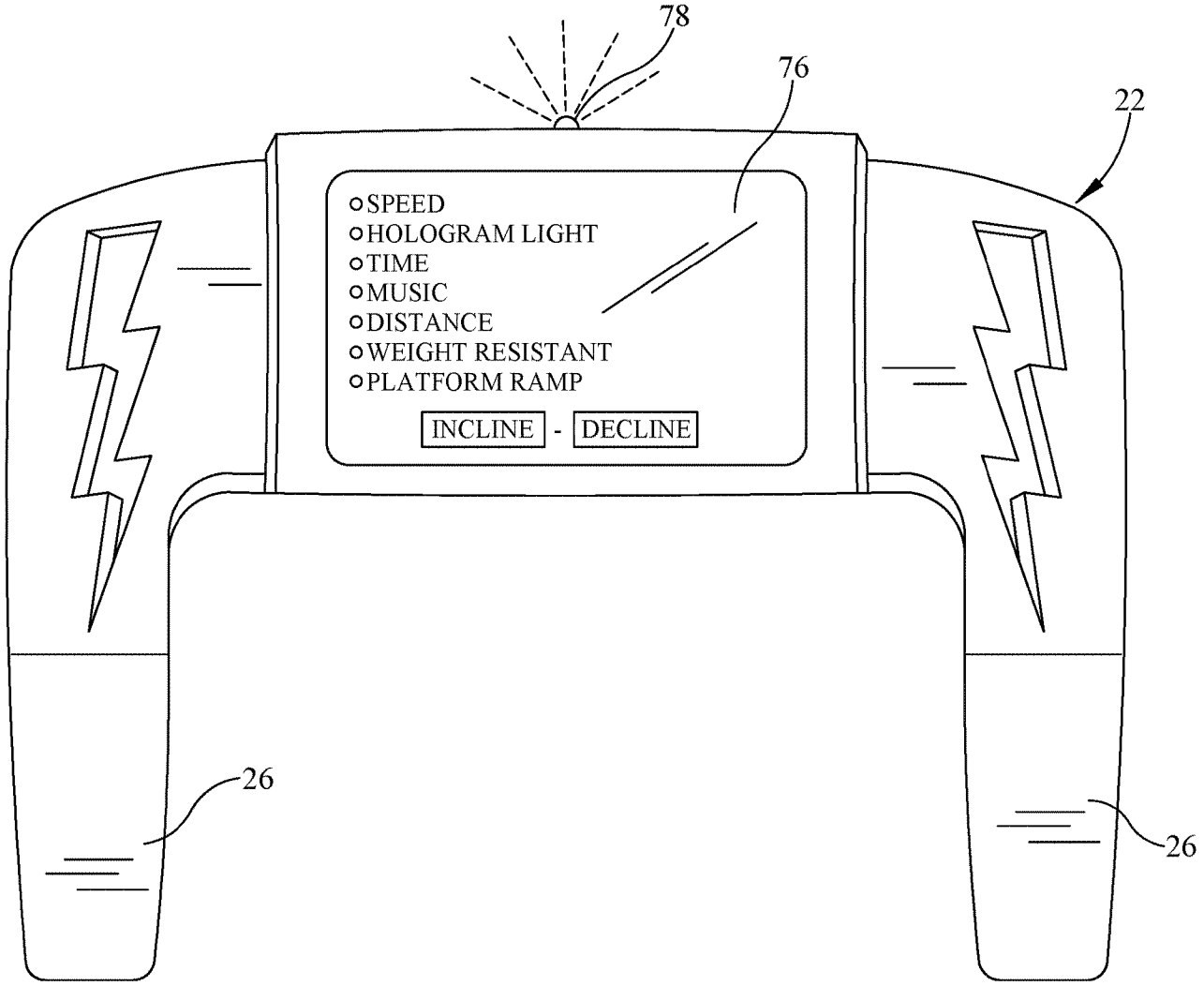
FIG. 4 is a plan view of the control console used to operate the all-in-one exercise machine for developing speed, agility, and strength.
Figure 6:
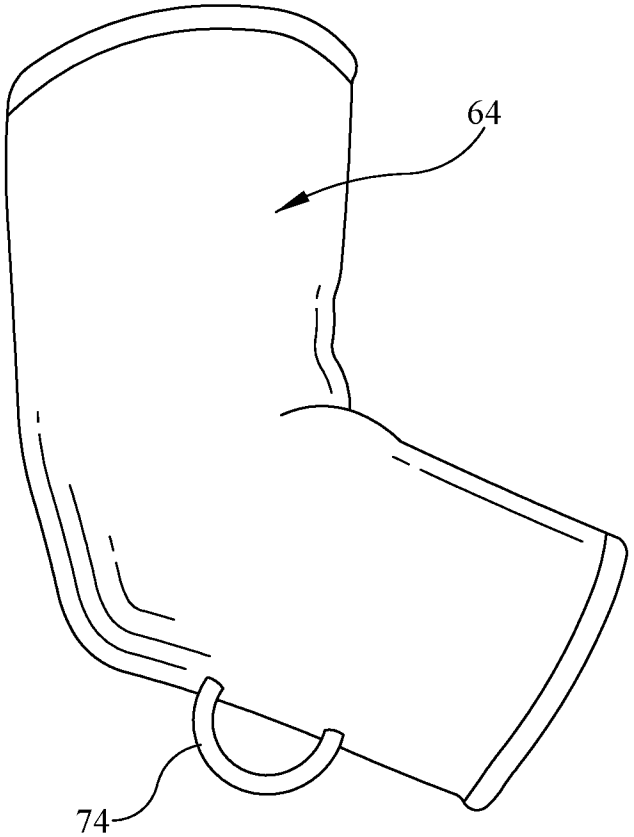
FIG. 6 is a perspective view of the elbow sleeve used with the all-in-one exercise machine for developing speed, agility, and strength.
Figure 5:
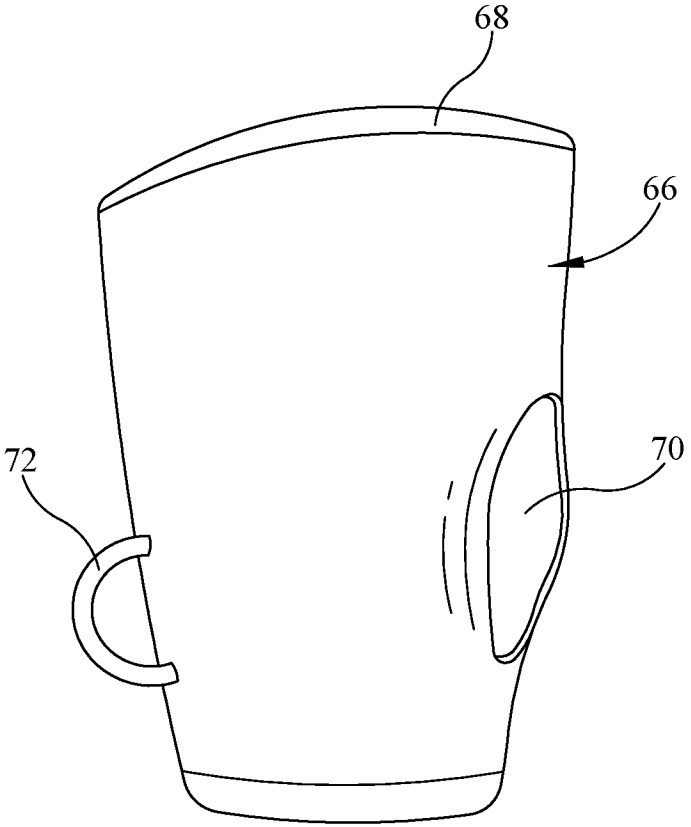
FIG. 5 is a perspective view of the hand sleeve used with the all-in-one exercise machine for developing speed, agility, and strength.
Figure 7:
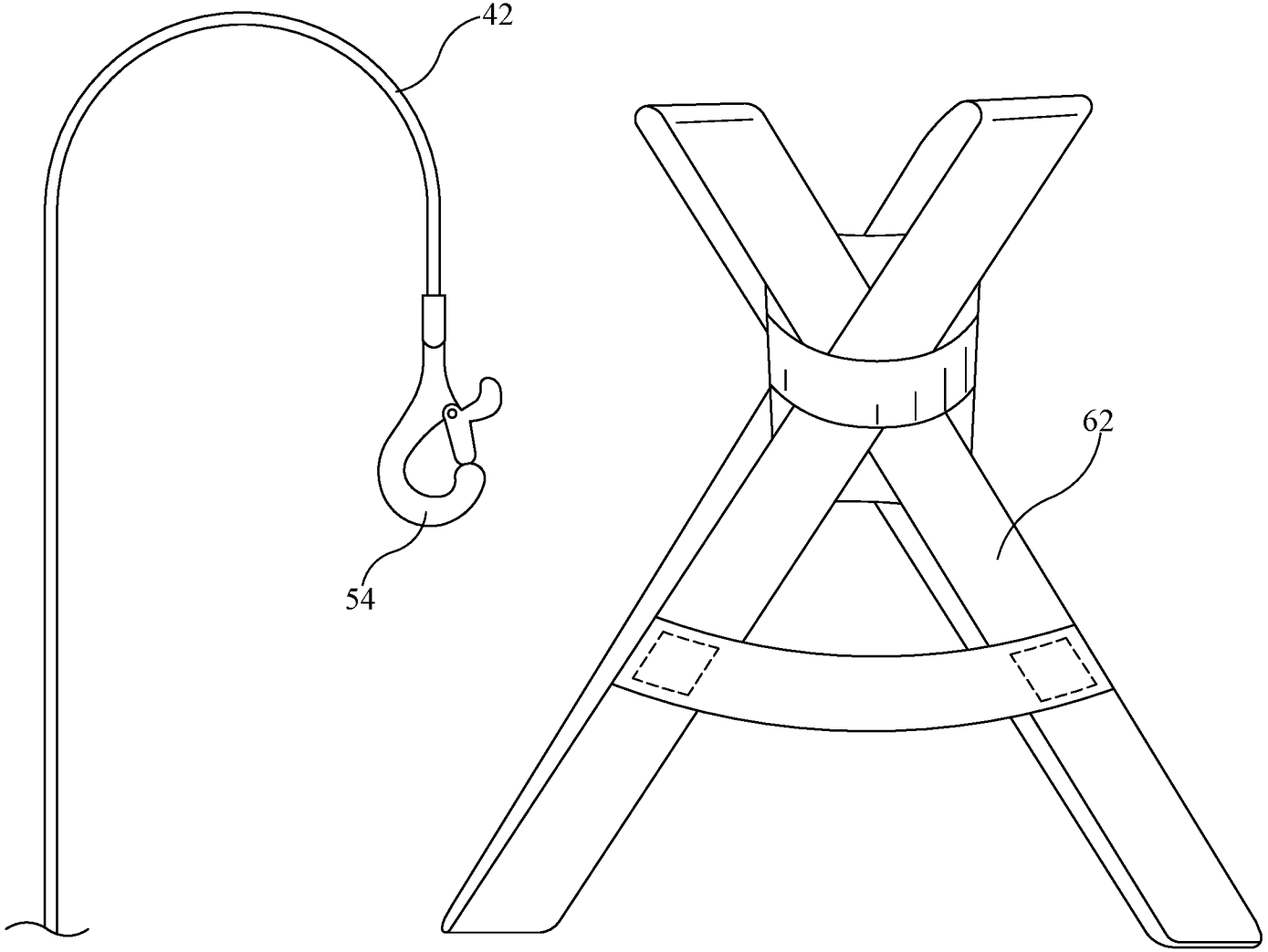
FIG. 7 is a perspective view of the body harness used with the all-in-one exercise machine for developing speed, agility, and strength.

Referring now to the drawings, it is seen that the all-in-one exercise machine for developing speed, agility, and strength of the present invention, generally denoted by reference numeral 10, is comprised of a main deck 12 and an extension deck 14 that slides along a pair of rails 16 so that the extension deck 14 moves longitudinally with respect to the main deck 12 and can be positioned in a retracted configuration abutting the front of the main deck 12 and an extended configuration, extending out from the main deck 12. By having the extension deck 14 extendable from the main deck 12 allows the all-in-one exercise machine for developing speed, agility, and strength 10 to be extended to allow sufficient room for a user A to utilize the device during vigorous workouts, while also allowing the device to be retracted into a smaller footprint for storage and ease of transport purposes. Of course, a single overall base without extension can also be used. Appropriate feet 18 are located on the main deck 12 while wheels 20 are located on the extension deck 14 for ease of transport of the all-in-one exercise machine for developing speed, agility, and strength 10, although feet can be used in place of wheels if desired.

As seen, a control console 22 extends upwardly from the top of the extension deck 12 via one or more posts 24 and may have hand grips 26 extending rearwardly therefrom.

Located on the main deck 12 is a treadmill 28. The treadmill 28 may be powered by an electric motor 30 in typical fashion so that the electric motor 30 controls the speed of the belt 32 as is typical with motorized treadmills. Alternately, the treadmill may be a manual treadmill that is powered by the user's leg powers. In such a configuration, an appropriate flywheel (not illustrated) along with a variable resistance device, either a mechanical contact type of device or a magnetic contact free device, can be used to allow the variance of resistance placed on the flywheel in order to vary the resistance of the belt to movement—increasing the resistance on the flywheel requires increased force by the user A to move the belt of the treadmill. Advantageously, the variable resistance device is electrically controlled so that the user A can change the resistance via the control console 22 during a workout without the need to get off of the all-in-one exercise machine for developing speed, agility, and strength 10 to manually change the resistance. However, manual control is also possible.

Irrespective of the type of treadmill 28 used, the deck 34 of the treadmill 28 can be inclined at a desired angle relative to the surface G upon which the all-in-one exercise machine for developing speed, agility, and strength 10 is placed (and also relative to the main deck 12). By way of example, such variance of the angle of incline of the deck 34 can be achieved via the illustrated non-symmetrical scissors lift 36 powered by an appropriate motor (not illustrated) so that the higher the scissors lift 36 is raised, the greater the angle of incline of the deck 34 of the treadmill 28. Of course, other types of deck incline systems can be used including the use of a system that relies on the output of the main treadmill motor 30 if an electric treadmill 28 is used, as is well known in the art.

A resistance hub housing 38 is located at the back end of the main deck 12. Located within the resistance hub housing 38 is a main resistance hub 40 which has a main cable 42 extending therefrom. Located on the distal end of the main cable 42 is a carabiner 44 or similar type of hook. The main resistance hub 40 is a variable resistance device upon which the main cable 42 partially winds about a spool 46 of the main resistance hub 40—basically, the main resistance hub 40 is a variable resistance take up reel. Pulling on the main cable 42 works against the resistance imparted on the main resistance hub 40. The main resistance hub 40 can be any appropriate take up reel such as a mechanical device wherein the spool winds via an internal spring (mechanical version of the resistance hub not illustrated). The variable resistance is provided via an appropriate device such as either a mechanical contact type of device or a magnetic contact free device that allows the variance of resistance placed on the spool of the resistance hub in order to vary the resistance needed to unwind the main cable. Advantageously, the variable resistance device is electrically controlled so that the user A can change the resistance via the control console 22 during a workout without the need to get off of the all-in-one exercise machine for developing speed, agility, and strength 10 to manually change the resistance of the main resistance hub. However, manual control is also possible.

Alternately, the main resistance hub 40 can use a variable torque electric motor 48 to rewind the spool 46 so that with increased torque output of the motor 48, increased force is needed to unwind the main cable 42 therefrom.

Also located within the resistance hub housing 38, on either side of the main resistance hub 40 is a pair of secondary resistance hubs 50 which each have a secondary cable 52 extending therefrom. Located on the distal end of each secondary cable 52 is a carabiner 54 or similar type of hook. Like the main resistance hub 40, each of the secondary resistance hubs 50 is a variable resistance device upon which the secondary cable 50 partially winds about a spool 56 of the secondary resistance hub 50—basically, each secondary resistance hub 50 is a variable resistance take up reel, albeit smaller relative to the main resistance hub 40 as the main resistance hub 40 is targeting the legs and torso muscles of the user A while the secondary resistance hubs are targeting the arm muscles of the user A as more fully explained below. Pulling on each secondary cable 52 works against the resistance imparted on the respective secondary resistance hub 50. Similar to the main resistance hub 40, each secondary resistance hub 50 can be any appropriate take up reel such as a mechanical device wherein the spool winds via an internal spring (mechanical version of the resistance hub not illustrated). The variable resistance is provided via an appropriate device such as either a mechanical contact type of device or a magnetic contact free device that allows the variance of resistance placed on the spool of the resistance hub in order to vary the resistance needed to unwind the secondary cable 52 therefrom. Advantageously, the variable resistance device is electrically controlled so that the user A can change the resistance via the control console 22 during a workout without the need to get off of the all-in-one exercise machine for developing speed, agility, and strength 10 to manually change the resistance of the main resistance hub. However, manual control is also possible.

Alternately, each secondary resistance hub 50 can use a variable torque electric motor 58 to rewind the spool 56 so that with increased torque output of the motor 58, increased force is needed to unwind the secondary cable 52 therefrom.

As seen, a series of carabiners 60 is located along a side edge of the main deck 12 in spaced apart fashion.

In order to use the all-in-one exercise machine for developing speed, agility, and strength 10 of the present invention, extended deck 14 is extended from the main deck 12 as desired. The user A dons the body harness 62 about the user's torso. The carabiner 54 of the main cable 42 is hooked onto the body harness 62, either to a strap thereof, as illustrated, or to a separate eyelet (not illustrated) that may be located on the body harness 62. The user A dons each elbow sleeve 64 and each hand sleeve 66 with the user's fingers extending through the main opening 68 of each hand sleeve 66 and the user thumbs extending through the side opening 70 of each hand sleeve 66. Each secondary cable 52 is passed through an eye 72 (openable as illustrated as the carabineer 54 on the secondary cable 52 may be too large to pass through a non-openable eye) located on the elbow sleeve 64 and is thereafter clipped onto an eye 74 located on the hand sleeve 66. The user A then sets the various parameters of the device via the screen 76 located on the control console 22, which may be touch screen controlled, as illustrated, or may have separate control buttons (not illustrated). Parameters to be set include the speed of the treadmill 28 if motor powered 30 or the resistance placed on the flywheel if the treadmill is a manual treadmill. The user A sets the desired angle of incline of the treadmill 28. The user A also sets how much resistance is going to be imparted onto the main resistance hub 40 and onto each of the secondary resistance hubs 50. The user A then presses an appropriate start button and thereafter beings walking or running on the treadmill 28. The main resistance hub 40 provides resistance against running on the treadmill, irrespective of the type of treadmill used, so that the user A is stressing leg and torso muscles. Each of the secondary resistance hubs provide arm resistance during the walk or run, thereby stressing the arm muscles. Of course, the user A can change any of the parameters during the course of a workout. The electrical wiring (not illustrated) between the control console 22 and the various components on the main deck 12 passes through one of the rails 16 connecting the main deck 12 and the extension deck 14 and through one of the rails of the scissors lift 36. The device is otherwise plugged into a typical wall electrical outlet in normal fashion. The main cable 42 and each of the secondary cables 52 have an appropriate stop mechanism (not illustrated) so that if a certain amount of a particular cable is wound about its spool, then the rewind mechanism of the particular resistance hub is stopped either mechanically or electrically, depending on the particular design of the resistance hub, this stop feature being a safety feature of the device.

Of course, the control console 22 can also have a timer, a countdown clock, distance counter, calories burned counter, various workout routines, and other functions, as are typical in such devices. Additionally, the control console 22 can be used to control other functions as well, such as turning on projection lights 78 that can project the console's contents onto a wall surface so that the user A does not need to look down at his or her progress but can simply look at the wall, music volume, that may be played by the control console 22, TV channel changer, etc. The control console 22 may also have an appropriate headphone jack (not illustrated) as well as a USB jack (not illustrated) either to upload data into the console 22 or download data from the console 22.

Figure 10:
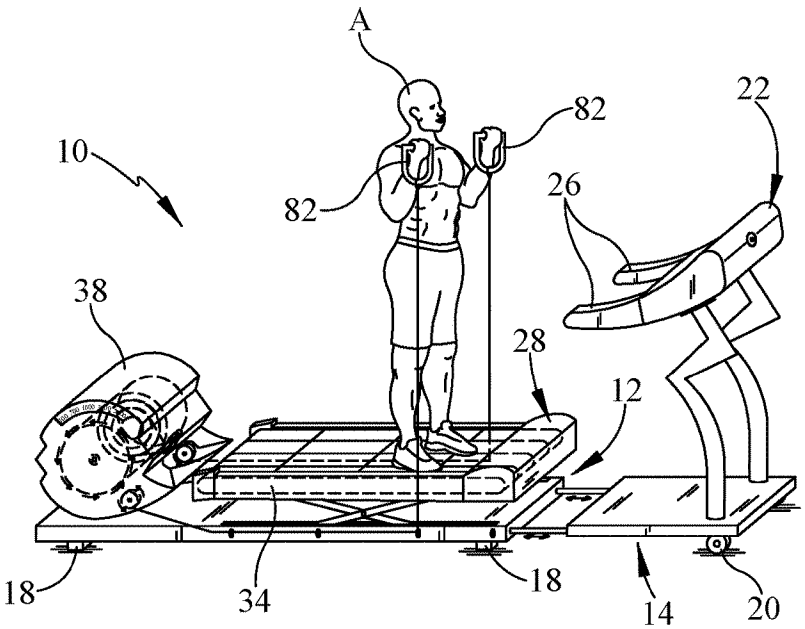
FIGS. 8-10 are environmental views of some of the weight training exercises that can be performed on the all-in-one exercise machine for developing speed, agility, and strength.
Figure 8:
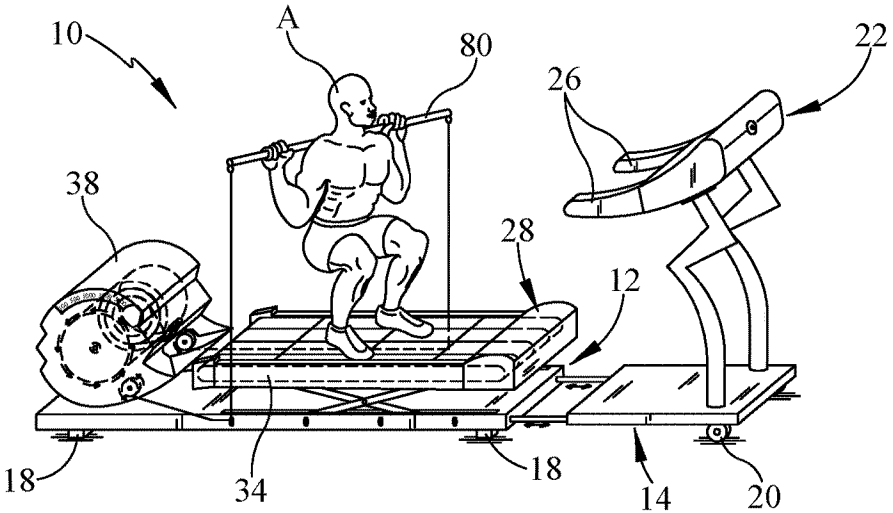
Figure 9:
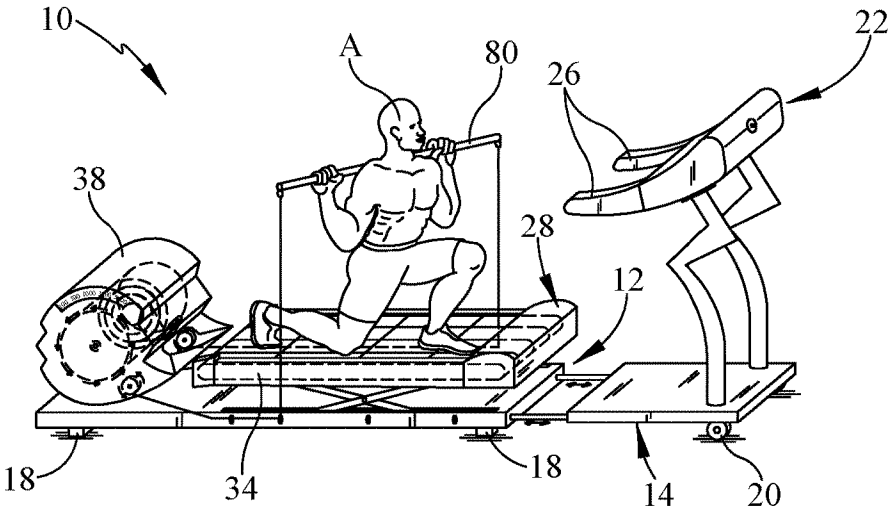

As seen, the secondary cables 52 may be passed through at least some of the carabiners 60 located on the side of the main deck 12 and the all-in-one exercise machine for developing speed, agility, and strength 10 is used as a weight lifting system. Appropriate devices such as a lift bar 80, as seen in FIGS. 8 and 9, or hand grips 82, as seen in FIG. 10, are clipped onto the end of each secondary cables 52 via their respective carabiner 54 and the user A lifts against the resistance force provided by the secondary resistance hubs 50.

The belt 32 of the treadmill 30 may have a series of longitudinal lines 84 located thereon (scored, colored, imprinted, etc.) as well as a series of latitudinal lines 86 located thereon (scored, colored, imprinted, etc.), the series of longitudinal lines 84 and latitudinal lines 84 forming a series of rectangles 88 on the belt 32. These rectangles 88 are equally sized (at least the ones that are interior from the sides of the belt 32) and are sized to allow a user's foot to land within or substantially within one of the rectangles 88 so that each rectangle 88 is at least about 15 inches long (for most user's feet size) and at least about 8 inches wide (again for most user's feet size). These rectangles 88 are used by a user A to undertake a ladder drill during a workout in order to improve agility, and otherwise improve overall foot-work, speed, quickness, balance, coordination and precision thus making the user faster in his or her sport.

While the invention has been particularly shown and described with reference to an embodiment thereof, it will be appreciated by those skilled in the art that various changes in form and detail may be made without departing from the spirit and scope of the invention.

I claim:

1. An exercise machine comprising:

a main deck having a first section, having a first forward end and an opposing first rearward end and a second section, having a second forward end facing the first rearward end, the second section also having an opposing second rearward end;

a control console located on the first section of the main deck;

a treadmill located on the second section of the main deck, the treadmill having a front end and a back end, the treadmill having a continuous running belt thereon;

a pair of parallel rails that extend rearwardly from the first rearward end of the first section of the main deck so that the second section of the main deck longitudinally slides along the rails so as to be longitudinally adjustable with respect to the first section so that the distance between the treadmill and the control console is longitudinally variable during treadmill operation;

a resistance hub located on the second section of the main deck proximate the back end of the treadmill, the resistance hub having a spool, the spool having a winding force imparted thereon; and a cable having first end and a second end such that the first end of the cable is attached to and partially wound about the spool so that placing a pulling force on the cable in order to unwind the cable from the spool works against the winding force imparted on the spool; a clip attached to the side of the main deck below the treadmill, the cable passing through the clip.

2. The exercise machine as in claim 1 wherein an angle of incline of the treadmill with respect to the main deck is variable.

3. The exercise machine as in claim 1 wherein the winding force imparted onto the spool is variable.

4. The exercise machine as in claim 1 further comprising a harness attached to the second end of the cable.

5. The exercise machine as in claim 1 further comprising:

a series of longitudinal lines located on the belt; and a series of latitudinal lines located on the belt, the series of longitudinal lines and the series of latitudinal lines together forming a series of rectangles on the belt.

6. An exercise machine comprising:

a main deck having a first section and a second section, the second section having a forward end and a rearward end joined by a left side and a parallel right side such that the first section is forward of the forward end of the second section;

a treadmill located on the second section of the main deck, the treadmill having a continuous running belt thereon;

a first resistance hub located on the second section of the main deck proximate the rearward end of the main deck, the first resistance hub having a first spool, the first spool having a first winding force imparted thereon;

a first cable having first end and a second end such that the first end of the first cable is attached to and partially wound about the first spool so that placing a first pulling force on the first cable in order to unwind the first cable from the first spool works against the first winding force imparted on the first spool;

a second resistance hub located on the second section of the main deck proximate the rearward end of the main deck, on a first side of the first resistance hub, the second resistance hub having a second spool, the second spool having a second winding force imparted thereon; and a second cable having third end and a fourth end such that the third end of the second cable is attached to and partially wound about the second spool so that placing a second pulling force on the second cable in order to unwind the second cable from the second spool works against the second winding force imparted on the second spool;

a third resistance hub located on the second section of the main deck proximate the rearward end of the main deck, on a second side of the first resistance hub, the third resistance hub having a third spool, the third spool having a third winding force imparted thereon;

a third cable having fifth end and a sixth end such that the fifth end of the third cable is attached to and partially wound about the third spool so that placing a third pulling force on the third cable in order to unwind the third cable from the third spool works against the third winding force imparted on the third spool;

a first clip attached to the left side of the main deck below the treadmill, the second cable passing through the first clip; and a second clip attached to the right side of the main deck below the treadmill, the third cable passing through the second clip.

7. The exercise machine as in claim 6 wherein an angle of incline of the treadmill with respect to the main deck is variable.

8. The exercise machine as in claim 6 wherein the first winding force imparted on the first spool is variable.

9. The exercise machine as in claim 6 wherein the second winding force imparted on the second spool and the third winding force imparted on the third spool are each variable.

10. The exercise machine as in claim 6 further comprising a harness attached to the second end of the first cable.

11. The exercise machine as in claim 6 further comprising:

a first hand sleeve located on the fourth end of the second cable; and a second hand sleeve located on the sixth end of the third cable.

12. The exercise machine as in claim 11 further comprising:

a first elbow sleeve attached to the second cable; and a second elbow sleeve attached to the third cable.

13. The exercise machine as in claim 6 further comprising:

a third clip located on the fourth end of the second cable; and a fourth clip located on the sixth end of the third cable.

14. The exercise machine as in claim 6 further comprising a control console located on the first section of the main deck.

15. The exercise machine as in claim 14 wherein the first section of the main deck is longitudinally movable relative to the second section of the main deck.

16. The exercise machine as in claim 6 further comprising:

a series of longitudinal lines located on the belt; and a series of latitudinal lines located on the belt, the series of longitudinal lines and the series of latitudinal lines together forming a series of rectangles on the belt.

* * * * *